US005312105A

United States Patent [19]

Cleveland

[11] Patent Number: 5,312,105

[45] Date of Patent: May 17, 1994

[54] GOLF CLUB

[75] Inventor: Roger Cleveland, Los Angeles, Calif.

[73] Assignee: Roger Cleveland Golf Company, Inc., Paramount, Calif.

[21] Appl. No.: 983,721

[22] Filed: Dec. 1, 1992

[30] Foreign Application Priority Data

Jun. 11, 1992 [FR] France ..... 92 07309

[51] Int. Cl.[5] ..... A63B 53/02; A63B 53/04

[52] U.S. Cl. ..... 273/167 G; 273/167 H; 273/169

[58] Field of Search ..... 273/77 R, 77 A, 80 C, 273/167 G, 167 H, 169, 170, 171, 167 R

[56] References Cited

U.S. PATENT DOCUMENTS

| | | | |
|---|---|---|---|
| 3,762,717 | 10/1973 | Johnston | 273/167 G X |
| 3,967,826 | 7/1976 | Judice | 273/167 G X |
| 4,621,813 | 11/1986 | Solheim | 273/77 A |
| 4,695,054 | 9/1987 | Tunstall | 273/167 H X |
| 4,848,747 | 7/1989 | Fujimura et al. | 273/77 A |
| 4,955,610 | 9/1990 | Creighton | 273/80 C X |
| 5,046,733 | 9/1991 | Antonious | 273/167 H X |
| 5,160,136 | 11/1992 | Eger | 273/77 A |
| 5,193,805 | 3/1993 | Solheim | 273/77 A |

FOREIGN PATENT DOCUMENTS

| | | | |
|---|---|---|---|
| 1544211 | 4/1979 | United Kingdom | 273/80 C |
| 92019329 | 11/1992 | World Int. Prop. O. | 273/80 C |

*Primary Examiner*—William E. Stoll
*Attorney, Agent, or Firm*—Parkhurst, Wendel & Rossi

[57] ABSTRACT

A golf club head including a sloping front face having a grooved striking zone for impacting a golf ball, a toe, and a heel, said face including in addition to said striking zone a wide zone adjacent said toe and a narrow zone adjacent said heel, and at its base a lower, leading edge; and an integral hosel segment including a bore for receiving a shaft; wherein said hosel extends from said narrow zone between said heel portion and said striking zone, and the axis of said hosel bore is spaced from the tip end of said heel by a distance of at least 8 mm. Preferably, the back surface of the club head has perimeter weighting which is redistributed along the upper edge of the club to the heel and toe portions.

20 Claims, 5 Drawing Sheets

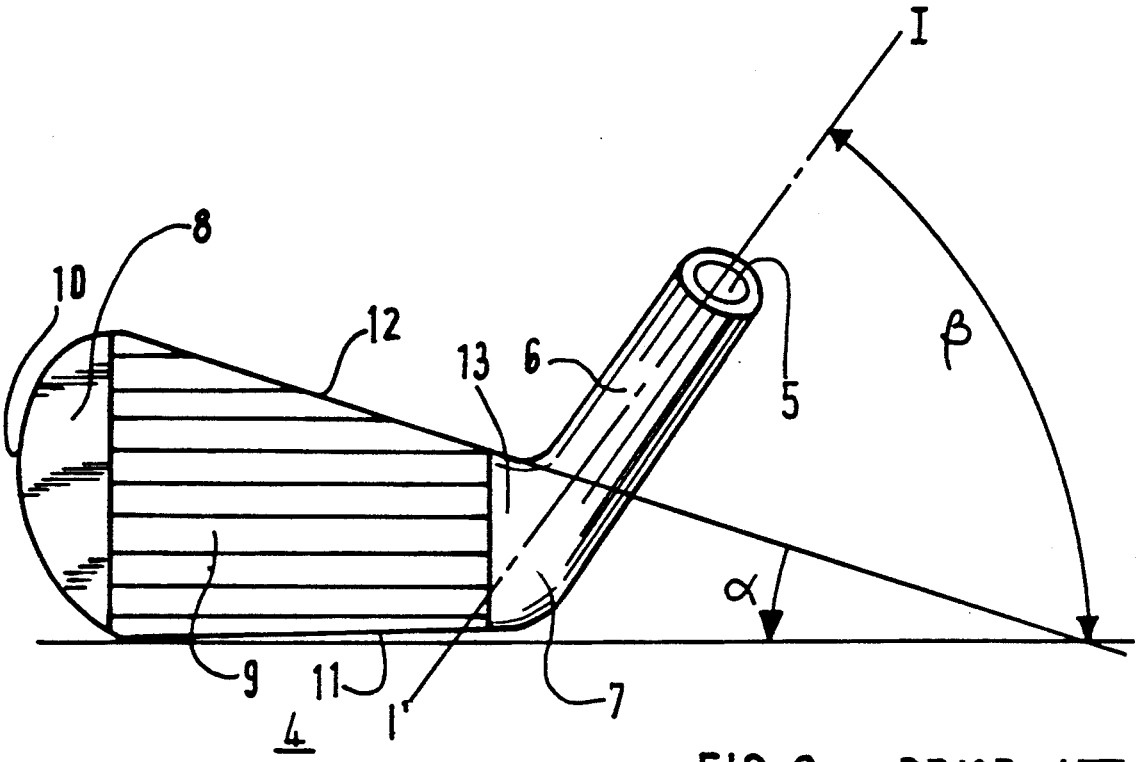
FIG. 3 - PRIOR ART
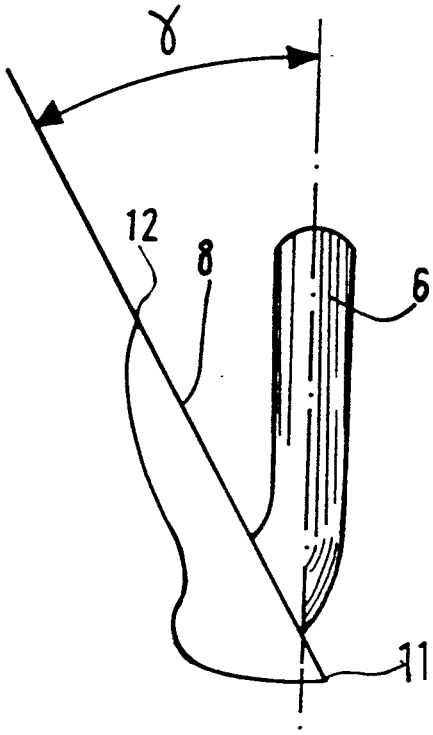
FIG. 4 - PRIOR ART

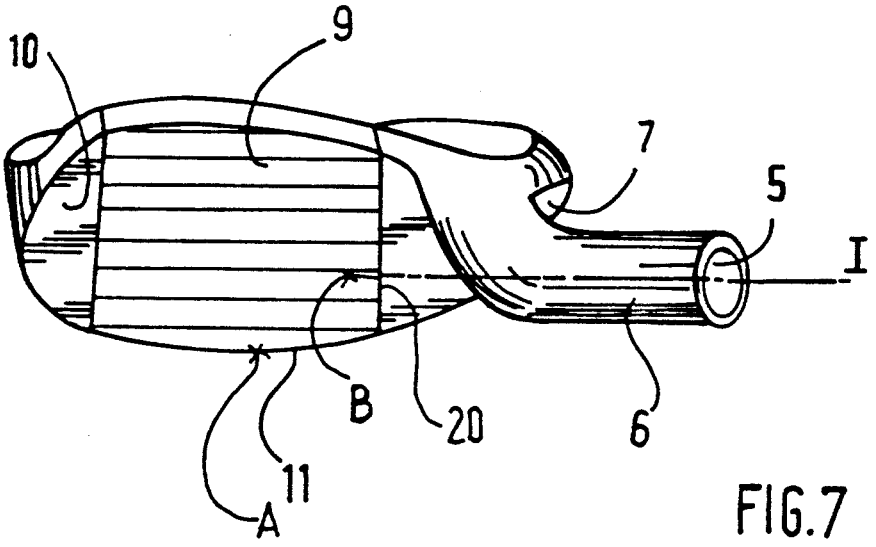
FIG.7
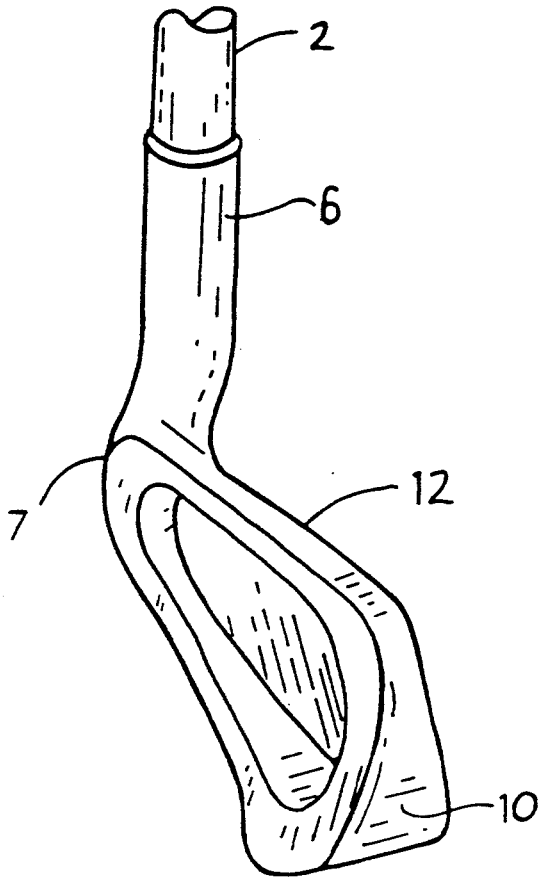
FIG.8 - PRIOR ART

GOLF CLUB

BACKGROUND OF THE INVENTION

The invention relates in general to iron or wood type gold clubs.

While the description of the invention below relates more specifically to irons, it is nevertheless equally applicable to woods. It suffices that the strike face of the club, whether planar or slightly convex, is inclined relative to the ground.

For the sake of convenience and to facilitate the following description, FIG. 1 shows a golf club as oriented in use. The club is positioned in virtual manner in a system of mutually spatially orthogonal planes P1, P2, P3 (FIG. 1), wherein the shaft axis I-I' is located in the P1 plane, the P3 plane denotes the ground, and the P2 plane is orthogonal to the ground, passes through the axis of the strike zone and is orthogonal to the P1 plane. The club shaft forms an angle $\beta$, also called the "lie angle" relative to an axis Ox contained in the P3 plane.

FIGS. 2 through 4 show a prior art golf club, in this instance an iron. FIG. 2. shows a front view of the entire golf club. FIG. 3 and 4 show front and side views, respectively, of the head of the golf club.

Such an iron, denoted by the overall reference 1, essentially comprises a grip 3 affixed to a shaft 2 connected to the head 4 by a hosel 6, which receives the shaft 2 in a bore 5 thereof. More specifically, the bore 5 is inside the hosel 6 which is connected to a head 4 at the end of the heel 7 of the head.

The actual head 4, whether metallic, molded or forged, or of machined wood, comprises a front strike face 8 slanted at an angle $\gamma$ (FIG. 4) relative to an Oy axis contained in the P1 plane (FIG. 1). The angle is called the opening or "loft" angle. The strike face 8 comprises a grooved striking zone 9 which is bounded at its base by a lower, leading edge 11 and at its top by an upper edge 12. The upper edge 12 slopes when projected onto the plane P1 by an angle $\alpha$ (FIG. 3) relative to the axis Ox defining the ground.

The grip 3 and shaft 2 define a longitudinal axis I-I' along which is located the bore 5 connecting the shaft 2 to the hosel 6. The sloping front strike face 8 comprises two side zones 7 and 10 on either side of the grooved striking zone 9. The wide free end zone 10 is adjacent the toe of the club head, and the opposite narrow zone connected to the shaft includes a connection segment 13 between the striking zone 9 and the hosel 6. This smooth connection segment 13 ends in the heel 7 and is linked to the hosel 6. Accordingly the hosel 6 comprises two main parts: a connection segment 13, at the heel 7, which as a rule will be tangential to and at the end of the heel, and a straight end comprising a bore 5 to connect the shaft 2 to the club head.

Heretofore, the hosel 6 as a rule has been aligned with the shaft 2 along the longitudinal axis I-I' and, as already mentioned, is located at the end of the heel 7, that is, at the most narrow end of the front strike face 8. More specifically, the hosel is connected to the head 4 at the heel 7 of the smooth connection segment 13.

It is known that at the time of impact between the head 4 and a golf ball, the shock generates a torsion and vibrations propagate along the shaft 2 as far as the grip 3. In the first place there is discomfort, and then player fatigue, which may go as far as trauma to the arm.

U.S. Pat. No. 4,986,541 describes more easily played irons for average or relatively inexperienced players.

This patent proposes a relationship to vary the "face progression", that is, seen in profile, the distance between the longitudinal grip axis I-I' and the most advanced point of the lower edge 11 of the head 4. It is known that the more the axis I-I' is behind the lower edge 11, the more the ball tends to rise. This makes it difficult to use long irons, that is, irons with shallow sloping angles $\gamma$ for their strike faces, for instance angles $\gamma$ between ten and twenty degrees. To achieve this offset of the "face progression", the irons made according to the disclosure of U.S. Pat. No. 4,986,541 include a hosel which is offset in the plane P2.

However in all the embodiments of U.S. Pat. No. 4,986,541, the connection segment 13 of the hosel 6, is tangential to the most narrow end of the head 4. In other words, the connection segment 13 coincides with the heel 7. As a result, the connection segment 13 is comparatively far from the striking zone 9, hence from the ideal center of impact with a golf ball. During impact, therefore, there still is a substantial torque.

British Patent 2,109,249 describes a golf club of which the shaft joins the hosel of the club head by means of an elbow and a fitting. In this design the shaft can be pointed in a given direction so it may be possible to change the head positions relative to the shaft as needed. Unfortunately, when the shaft is angularly offset inside the fitting, all the relative parameters also will change, and this club, which moreover is costly and fragile, is inconvenient in practice.

U.S. Pat. No. 3,966,210 describes a club, in particular a putter, of which the shaft joins the head by a hosel substantially back from the strike face. This design is applicable to the putter clubs or to so-called "woods", but not to irons, especially those with a wide loft angle, because it is technically impossible to arrange the shaft at the back of the head.

Other prior art golf clubs also include so-called "perimeter weighting" means to make the clubs more easily used by inexperienced players. For example, FIG. 8 shows a golf club head as disclosed in U.S. Pat. No. 4,621,813, which employs redistributed perimeter weighting on the back surface of the club to improve resistance to twisting of the club head upon off-center impacts with a golf ball. However, the perimeter weighting is redistributed and concentrated only at the lower edge heel and toe portions of the club back surface, and no redistribution of the perimeter weighting is provided on the top edge of the club. Nor is there any disclosure or recognition in the art of the importance of redistributing the perimeter weighting at the top edge of the club.

SUMMARY OF THE INVENTION

A first object of the invention is to overcome the above-discussed drawbacks of the prior art. More specifically, an object of the present invention is to provide a golf club having a sloping strike face and which evinces reduced torque.

A first embodiment of the present invention relates to an iron or wood type golf club comprising:

- a sloping front face having a grooved striking zone for impacting a golf ball, a toe, and a heel, said face comprising in addition to said striking zone a wide zone adjacent said toe and a narrow zone adjacent said heel, and at its base a lower, leading edge;
- an integral hosel segment including a bore for receiving a shaft;

wherein said hosel extends from said narrow zone between said heel portion and said striking zone, and the axis of said hosel bore is spaced from the tip end of said heel by a distance of at least 8 mm.

In a preferred embodiment of the present invention, the longitudinal shaft axis intersects the strike face inside the grooved striking zone or just ahead of the leading, lower edge of the strike face in an extension of the plane of the striking zone. In other words, the invention comprises the following features:

a) the position of connection of the hosel to the club head is no longer at the end of the heel, but rather, in the narrow zone of the strike face which is located between the heel and the grooved striking zone; and b) the distance between the end tip of the heel and the longitudinal shaft axis or its extension is between 16 mm (i.e., ⅝ inches), the limit as set by the USGA, and half that amount, i.e., 8 mm.

A second object of the present invention is to provide a golf club head having improved perimeter weighting on the back surface thereof, so as to resist more effectively twisting of the club head upon off-center impacts with a golf-ball. The golf club of the second embodiment of the present invention comprises a hosel extending from a head body, a front face having a striking zone for impacting a golf ball, a back surface, a toe portion, a heel portion, a sole, and a top convexly curved surface extending from said heel portion to said toe portion, said back surface having a rearwardly extending ridge which merges with said top surface and extends rearwardly at least along the upper edge of said back surface from said heel portion to said toe portion, wherein said ridge decreases in thickness, when measured in a direction substantially perpendicular to said front face, from said heel and toe portions to a thinner central region thereof, such that the mass of said ridge is concentrated in the heel and toe portions thereof.

In a preferred embodiment of the present invention, the golf club head includes the features of the above-discussed first and second embodiments.

BRIEF DESCRIPTION OF THE DRAWINGS

The above and other objects, features and advantages of the present invention will be better understood by reading the following detailed description when considered in conjunction with the accompanying drawings, in which:

FIGS. 3 and 4 show detailed front and side views, respectively, of the club head of FIG. 2.

FIGS. 5 through 7 illustrate an iron of a first embodiment of the present invention shown in front view, side view and top view, respectively.

FIG. 8 shows a rear view of a conventional golf club.

DETAILED DESCRIPTION OF THE INVENTION

Figure 2:
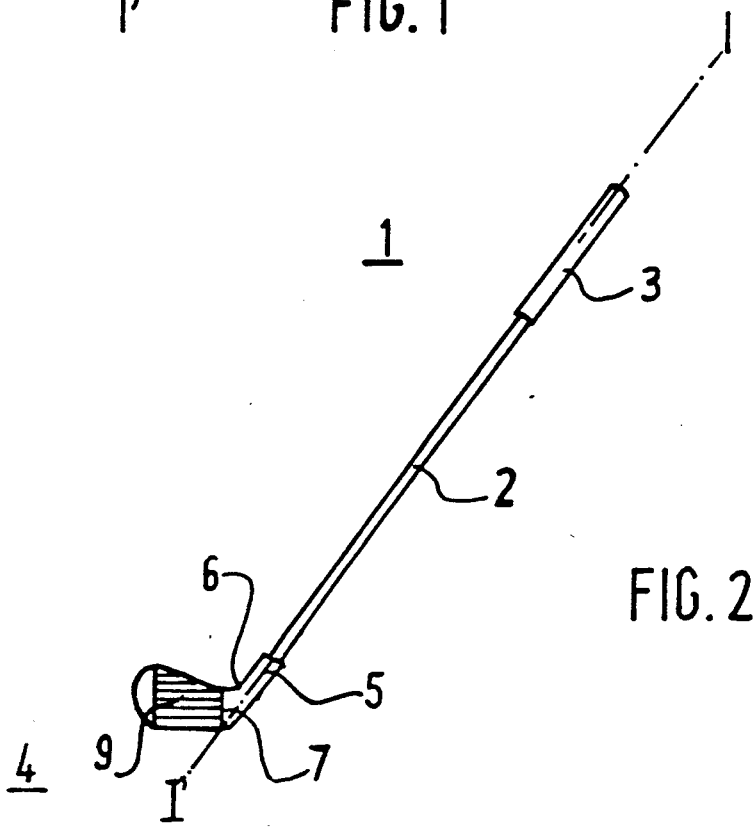
FIG. 2 shows a front view of a conventional golf club.
Figure 5:
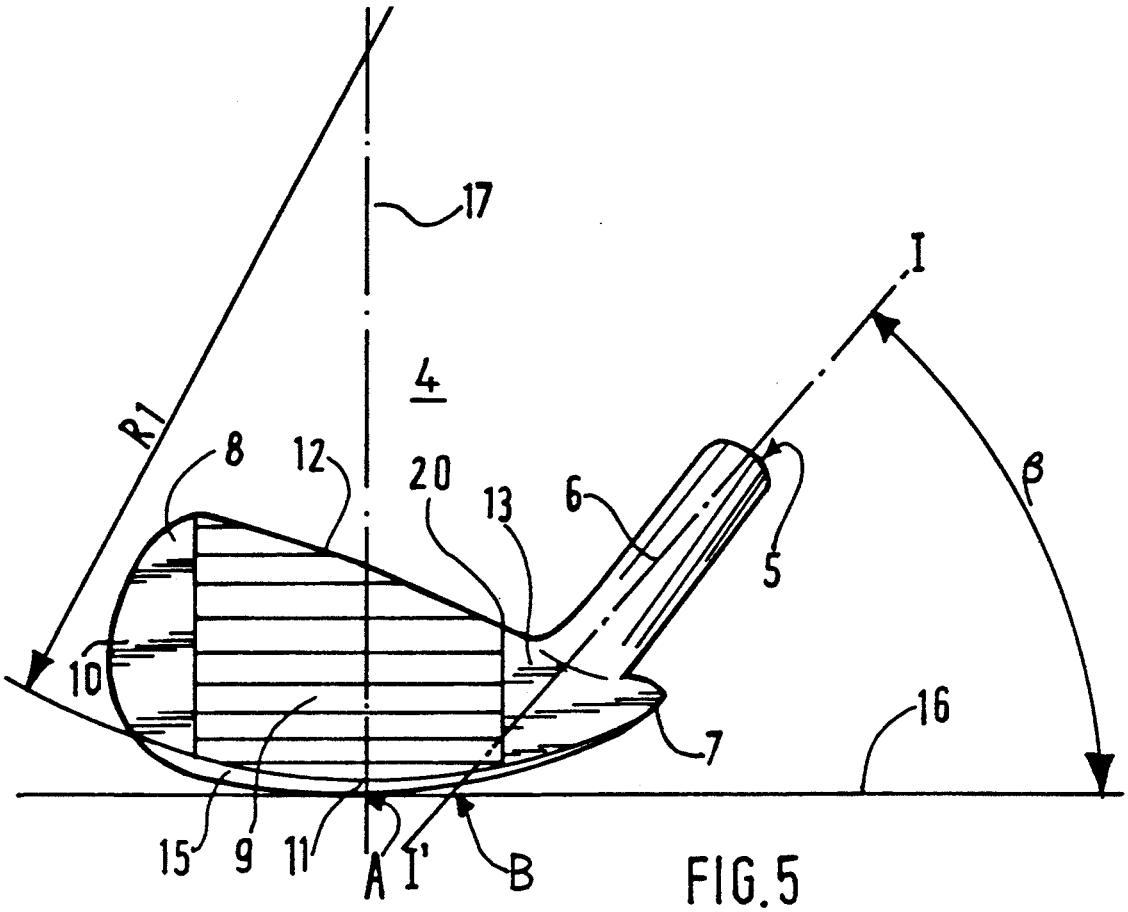
Figure 6:
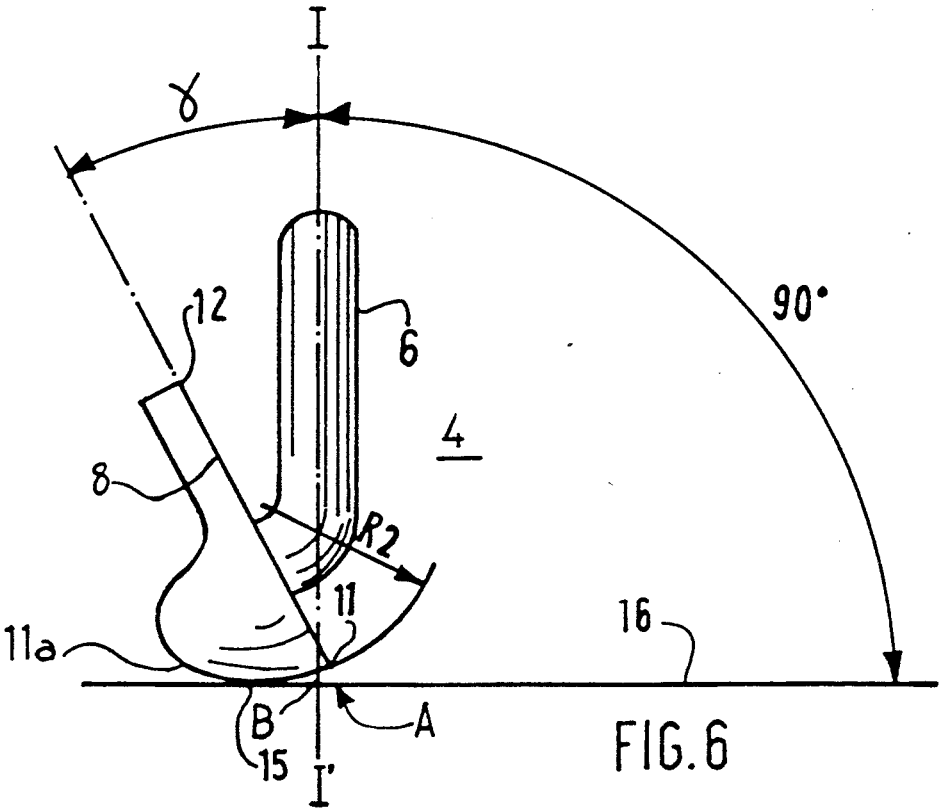

For the sake of simplicity, the components common to FIGS. 2–4 and FIGS. 5–7 will be referenced in FIGS. 5–7 using the same reference numerals used in FIGS. 2–4.

In FIGS. 5 through 7 of the invention, the club head includes a convexly curved sole 15, which is preferably, but not necessarily, curved from heel 7 to toe 10 and from leading edge 11 to trailing edge 11*a*. $R_1$ denotes the radius of curvature of the sole 15 as convexly curved from heel to toe, and $R_2$ denotes the radius of curvature of the sole 15 as convexly curved from leading edge to trailing edge. Preferably $R_1$ is equal to 5 inches and $R_2$ is equal to 2 inches.

The vertical projection point of the foremost point of the lower, leading edge 11 on the ground 16 is denoted by A (FIGS. 5 and 6). As already mentioned, the angle $\beta$ denotes the lie angle and the angle $\gamma$ denotes the loft angle of the front, strike face 8. The median line of the width of the grooved striking zone 9 is denoted by 17.

In the invention, the connection segment 13 of the hosel 6 is positioned mid-way between the heel 7 of the strike face 8 and the edge 20 of the actual striking zone 9. The distance between the end tip 7*a* of the heel 7 and the longitudinal axis I-I' of the shaft 2 is at least 8 mm, and preferably between 8 and 16 mm.

By positioning the hosel 6 inset from the end tip of the heel 7, the shaft axis I-I' is closer to the center of gravity of the club head when compared to conventional club heads as shown in FIGS. 2–4. Consequently, the moment of inertia about the shaft axis I-I' is reduced, which allows the club to return to square with less energy than conventional club heads in the event of off-center hits.

In another embodiment of the invention, the longitudinal axis I-I' of the shaft 2 intersects the planar strike face 8 in the grooved striking zone 9 (see FIG. 7). It is also possible that the longitudinal axis I-I' of the shaft 2 intersects an extension of the plane of the striking zone 9 in front of the lower, leading edge 11.

Advantageously and in practice, the connection segment 13 of the hosel 6 is joined to the front strike face 8 between the grooved striking zone 9 and the heel 7 near the upper edge 12, and the length of the hosel portion actually connected to the head increases with the loft angle of the club head.

Figure 1:
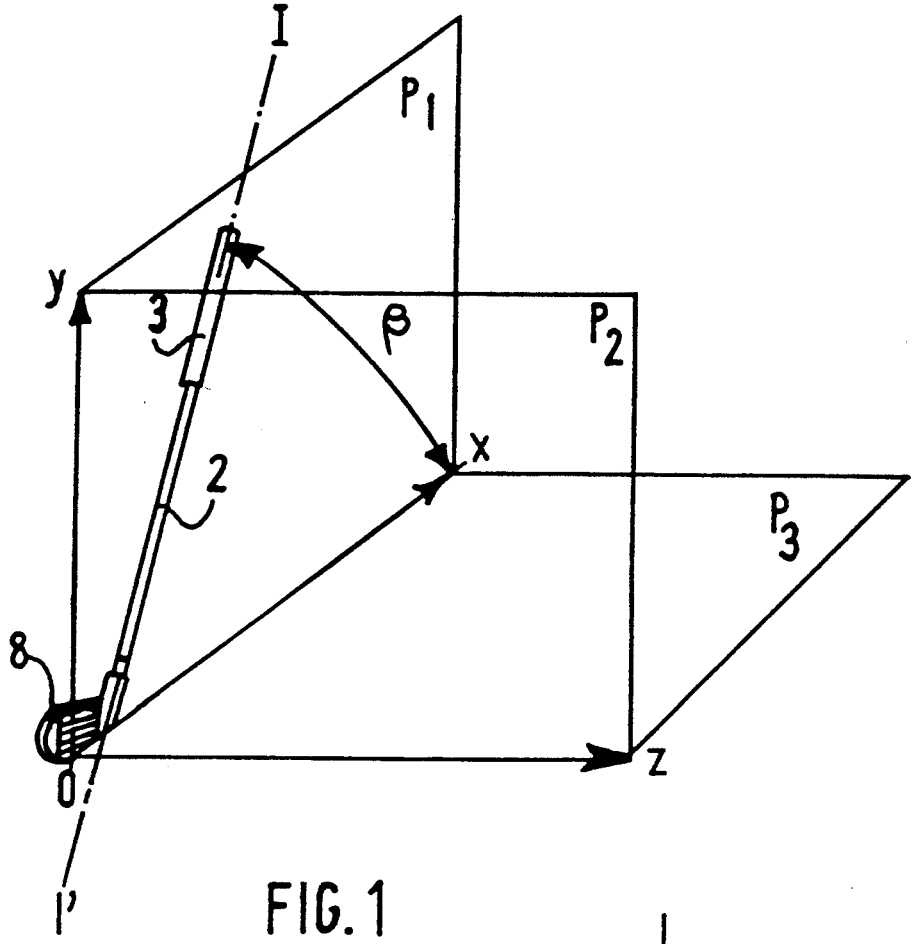
FIG. 1 shows the position of a club in three reference planes P1, P2 and P3.

Additionally, when the club head 4 rests on the plane P3, which is the ground, and when the longitudinal axis of the shaft I-I' is in a plane P1 perpendicular to the ground plane P3 (FIG. 1) and slopes in this plane by an angle $\beta$ (lie angle), which is characteristic of the selected iron, then, regardless of the selected iron number, a distance AB between a point A which is a vertical projection onto the plane P3 of the most advanced point 11 of the lower, leading edge of the club head 4 and a point B which is a projection onto the plane P3 of the longitudinal axis of the shaft shall be less than 30 mm.

The distance AB varies with the selected iron number as given by the relation below, again in mm:

| Iron Designation | ≦ | AB | ≦ |
|---|---|---|---|
| 1 | 18 | | 22 |
| 2 | 19 | | 23 |
| 3 | 20 | | 24 |
| 4 | 21 | | 25 |
| 5 | 22 | | 26 |
| 6 | 23 | | 27 |
| 7 | 24 | | 28 |
| 8 | 25 | | 29 |
| 9 | 26 | | 30 |
| PW | 26 | | 30 |

-continued

| Iron Designation | ≦ | AB | ≦ |
|---|---|---|---|
| SW | 26 | | 30 |

In another embodiment of the present invention, this characteristic distance AB varies in another relationship, namely, for long irons (irons 1, 2 and 3), between 0 and 20 mm; for middle irons (4, 5, 6), between 20 and 25 mm; and for short irons (7 through SW) between 25 and 30 mm.

In yet another embodiment, the distance AB is zero.

The hosel 6 can extend straight into the narrow zone of the front strike face 8 or can extend substantially normally from the narrow zone of the sloping front face 8 and curve upwardly and rearwardly from the heel 7 of the club head 4 within a substantially vertical plane.

Figure 9:
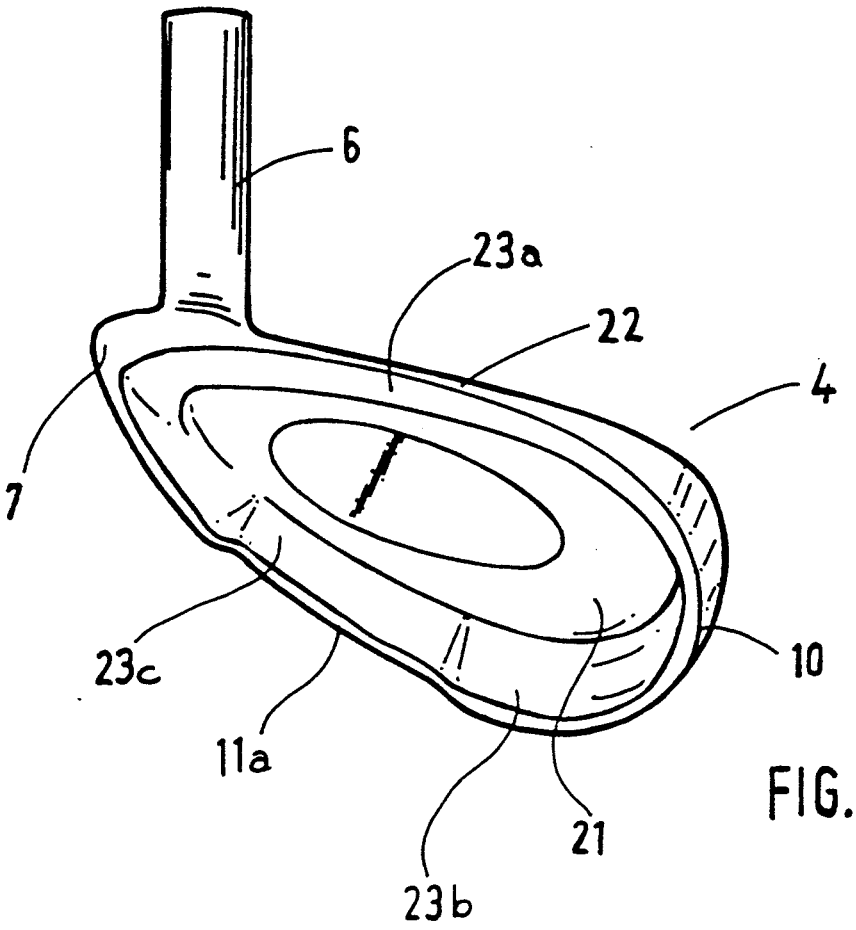
FIG. 9 shows a rear view of a second embodiment of the present invention.
Figure 10:
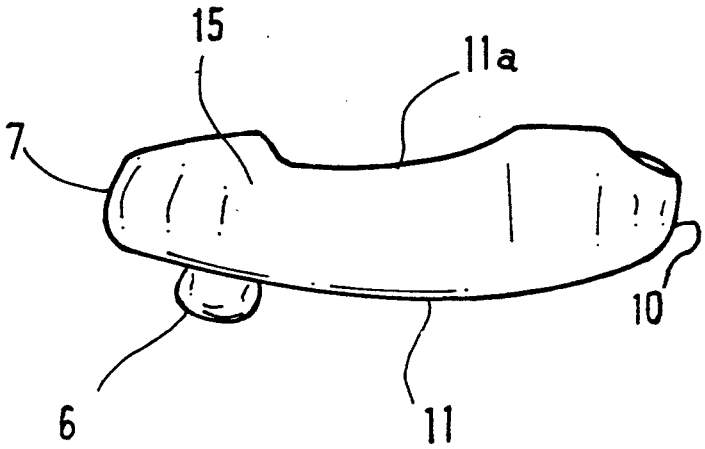
FIG. 10 shows a bottom view of the second embodiment of the present invention.

FIGS. 9 and 10 show a second embodiment of the present invention which concentrates on the perimeter weighting on the back surface 21 of the club head 4. The club head 4 includes a top convexly curved surface 22 extending from the heel 7 to the toe 10. A rearwardly extending ridge 23 merges with the top surface 22 and extends rearwardly at least along the upper edge of the back surface 21 from the heel 7 to the toe 10. The ridge 23 decreases in thickness, when measured in a direction substantially perpendicular to the front face 8 of the club head, from the heel 7 and toe 10 portions to a thinner central region 23*a* thereof, such that the mass of the ridge 23 at the upper edge of the back surface 21 is concentrated in the heel and toe portions thereof.

Preferably, the ridge extends along the outer periphery of the back surface 21 throughout the heel and toe portions, and increases in thickness from the central region 23*a* when measured in a direction substantially perpendicular to the front face 8. More preferably, the ridge 23 extends along the entire outer periphery of the back surface 21 and merges with the trailing edge 11*a* of the sole 15, and the ridge 23 is greatest in thickness in the sole 15 of the club head.

The back surface 21 of the club head is substantially planar and the portion 23*b* of the ridge 23 in the sole 15 of the club is flange-like and merges smoothly with the planar back surface 8. More preferably, the flange-like portion 23*b* of the ridge is of a lesser thickness in a central region 23*c* thereof. It is also preferred that the central region 23*c* of the flange-like portion 23*b* is thinner in the vertical direction within the central region. These combined features maximize heel-toe redistribution of the perimeter weighting both at the upper and lower edges of the club back surface 21.

It is preferred that the central region 23*a* of the ridge 23 at the top surface 22 is substantially coextensive with the central region 23*c* of the sole portion of the ridge (i.e., the flange-like portion 23*b*). This arrangement provides the center of gravity of the club head substantially between these central regions.

The AB feature and the projection of the shaft axis onto the actual striking zone, provide, at impact, reduced shock which results in reduced torque and hence attenuated vibrations. Moreover the improved perimeter weighting of the club head of the present invention minimizes twisting of the club head during off-center impacts with a golf ball. Contrary to the case of the conventional clubs, greater comfort and especially less fatigue are achieved for the player, especially for average or relatively inexperienced players, by using the golf clubs of the present invention.

What is claimed is:

1. An iron or wood type golf club head comprising:

a sloping front face having a grooved striking zone for impacting a golf ball, a toe, and a heel, said face comprising in addition to said striking zone a wide zone adjacent said toe and a narrow zone adjacent said heel, and at its base a lower, leading edge; and an integral hosel segment including a bore for receiving a shaft;

wherein said hosel extends from said narrow zone between said heel portion and said striking zone, and the axis of said hosel bore is spaced from the tip end of said heel by a distance of at least 8 mm.

2. The golf club head of claim 1, wherein said distance is between 8 mm and 16 mm.

3. The golf club head of claim 1, wherein the axis of said hosel bore intersects said striking zone within the head or outside the head and forward of said lower, leading edge in an extension of the plane of said striking zone.

4. The golf club head of claim 3, wherein said club head includes a sole which is convexly curved from heel to toe and from leading edge to trailing edge, such that when the sole of said club head rests on the ground, a distance AB between a point A, which is a vertical projection point on the ground of the foremost point of said lower, leading edge, and a point B, which is a projection point on the ground of the longitudinal axis of said hosel bore, is less than 30 mm.

5. The gulf club head of claim 4, wherein the distance AB is zero.

6. The golf club head of claim 4, wherein the distance AB ranges from about 0 mm to about 30 mm.

7. The golf club head of claim 6, wherein the distance AB ranges from about 18 mm to about 30 mm.

8. The golf club head of claim 1, wherein said hosel joins said sloping front face between the striking zone and the end tip of said heel near the upper edge of said sloping front face.

9. The golf club head of claim 1, wherein the hosel extends substantially normally from the narrow zone of the sloping front face and curves upwardly and rearwardly from the heel of the club within a substantially vertical plane.

10. A perimeter-weighted, iron-type golf club head comprising a hosel extending from a head body, a front face having a striking zone for impacting a golf ball, a back surface, a toe portion, a heel portion, a sole, and a top surface extending from said heel portion to said toe portion, said back surface having a rearwardly extending ridge which merges with said top surface and extends rearwardly at least along the upper edge of said back surface from said heel portion to said toe portion, wherein said ridge substantially continuously decreases in thickness, when measured in a direction substantially perpendicular to said front face, from said heel and toe portions to a thinner central region thereof, such that the mass of said ridge is concentrated in the heel and toe portions thereof.

11. The golf club head of claim 10, wherein said ridge extends along the outer periphery of said back surface throughout said heel and toe portions, and increases in thickness from said central region thereof, when measured in a direction substantially perpendicular to said front face.

12. The gold club head of claim 11, wherein said ridge extends along the entire outer periphery of said back surface and merges with the trailing edge of said sole, and is greatest in thickness in the sole of said club head.

13. The golf club head of claim 12, wherein a central portion of said back surface is substantially planar and the portion of said ridge in the sole of the club is flange-like and merges smoothly with said planar central portion of said back surface of the club head.

14. The golf club head of claim 12, wherein the portion of said ridge in the sole of the club head is flange-like from the heel to the toe of the club head and is of a lesser thickness in a central region thereof.

15. The golf club head of claim 14, wherein the central region of said ridge at said top surface and the central region of said sole portion of said ridge are substantially equally spaced from said toe portion along said back surface of the club head.

16. The golf club head of claim 15, wherein the center of gravity of said head is located substantially between said central regions.

17. The golf club head of claim 14, wherein the sole portion of the flange-like ridge is also thinner in the vertical direction within said central region.

18. The golf club head of claim 17, wherein said sole is also convexly curved from leading edge to trailing edge.

19. The golf club head of claim 10, wherein said sole is convexly curved from heel to toe.

20. A perimeter-weighted, iron-type golf club head comprising a sloping front face having a grooved striking zone for impacting a golf ball, a back surface, a toe portion, a heel portion, a sole, and a top convexly curved surface extending from said heel portion to said toe portion, said front face comprising in addition to said striking zone a wide zone adjacent said toe portion and a narrow zone adjacent said heel portion, said back surface having a rearwardly extending ridge which merges with said top surface and extends rearwardly at least along the upper edge of said back surface from said heel portion to said toe portion, wherein said ridge decreases in thickness, when measured in a direction substantially perpendicular to said front face, from said heel and toe portions to a thinner central region thereof, such that the mass of said ridge is concentrated in the heel and toe portions thereof, and an integral hosel segment including a bore for receiving a shaft, said hosel segment extending from said narrow zone between said heel portion and said striking zone, and the axis of said hosel bore being spaced from the tip end of said heel by a distance of at least 8 mm.

* * * * *